United States Patent [19]

Chang

[11] 4,011,596

[45] Mar. 15, 1977

[54] FOREARM AND WRIST PROTECTOR

[76] Inventor: Enrique G. Chang, 16992 Courtney Lane, Huntington Beach, Calif. 92649

[22] Filed: Dec. 3, 1975

[21] Appl. No.: 637,133

[52] U.S. Cl. ..... 2/16

[51] Int. Cl.[2] ..... A41D 13/08

[58] Field of Search ..... 2/16, 22, 159, 161 A, 2/161 R; 128/87 R, 88, 77, 165

[56] References Cited

UNITED STATES PATENTS

| | | | |
|---|---|---|---|
| 1,510,783 | 10/1924 | Johnson | 2/16 |
| 1,577,540 | 3/1926 | Punches | 2/16 |
| 2,082,574 | 6/1937 | Handley | 2/16 |
| 2,529,786 | 11/1950 | Shaw | 2/16 X |
| 3,189,919 | 6/1965 | Chase | 2/22 |
| 3,232,289 | 2/1966 | Zimmerman | 128/87 |
| 3,924,272 | 12/1975 | Allen | 2/16 |

*Primary Examiner*—Werner H. Schroeder
*Assistant Examiner*—Doris L. Troutman
*Attorney, Agent, or Firm*—Fulwider, Patton, Rieber, Lee & Utecht

[57] ABSTRACT

There is disclosed a protective device to reduce the hazards of fractures and injuries to the forearm and wrist that is particularly intended for wearing by skate board riders and the like who are subject to falls to hard paved surfaces which often result in fractures of the distal, ulna, radius or carpus. The device has a rigid, impact-absorbing, splint member which overlies the forearm and wrist of the wearer, extending from the elbow to the metacarpalphthlangic joint. In a preferred embodiment, the device includes first and second rigid, impact-absorbing, splint members that are connected by hinge means at the wrist to provide a limited freedom of flexing of the wrist and that overlie the undersurface of the forearm and palm of the wearer. Sleeve means are provided for removable attachment of the device to the limb of the wearer and appropriate cushioning layers are provided to insure the comfort of the device and, optionally, to provide enhanced impact absorbing capability.

8 Claims, 5 Drawing Figures

FOREARM AND WRIST PROTECTOR

BACKGROUND OF THE INVENTION

1. Field of the Invention

This invention relates to protective devices and, in particular, to an arm and wrist protector.

2. Brief Statement of the Prior Art

The high popularity of skateboards has resulted in a rash of injuries associated therewith. A very prevalent and typical injury resulting from falls from skateboards and the like is a fracture of the bones in the forearm and wrist such as the distal, ulna, radius and/or carpus. These fractures are caused by a person extending his arms, falling with the hands palm down to break the thrust of the fall. Usually the thrust of the fall is quite substantial and occurs on a hard, paved surface with the all too frequent result of fractures to the aforementioned bones.

Most of the aforementioned fractures could be prevented if the skateboard user wore a rigid splint-like, shock-absorbing, protective device. Various splint devices have been developed for immobilizing the forearm or wrist to promote healing of fractures of these bones. These devices are not readily adaptable for use as protective devices because they extend over a limited limb region and no single device provides complete protection and, furthermore, these devices are generally too confining and uncomfortable for receiving any widespread acceptance and use.

BRIEF STATEMENT OF THE INVENTION

This invention comprises a limb protecting device including, in its broad application, a rigid and load-bearing splint member intended to overlie the undersurface of a wearer's forearm and extending to the metacarpal-phthlangic joint, and in a preferred application a first, rigid and load-bearing splint member intended to overlie the undersurface of a wearer's forearm with a second splint member, secured thereto by flexible hinge means of limited freedom of movement, which extends from the wrist to the metacarpal-phthlangic joint of the wearer, thereby protecting the carpus and metacarpus bones.

The device includes limb attachment means in the form of a sleeve for encircling one or both of the forearm and wrist of the wearer with closure means such as Velcro fasteners, lacing, snaps and the like. Preferably, the device includes a layer of padding or cushioning material along the inside surface of one or both of the splint members and can include impact-absorbent cushioning material as a layer on the outer surface of one or both of the splint members.

BRIEF DESCRIPTION OF THE DRAWINGS

The invention will be described with reference to the illustrated and presently preferred embodiments thereof shown in the figures of which.

DESCRIPTION OF PREFERRED EMBODIMENTS

Figure 1:
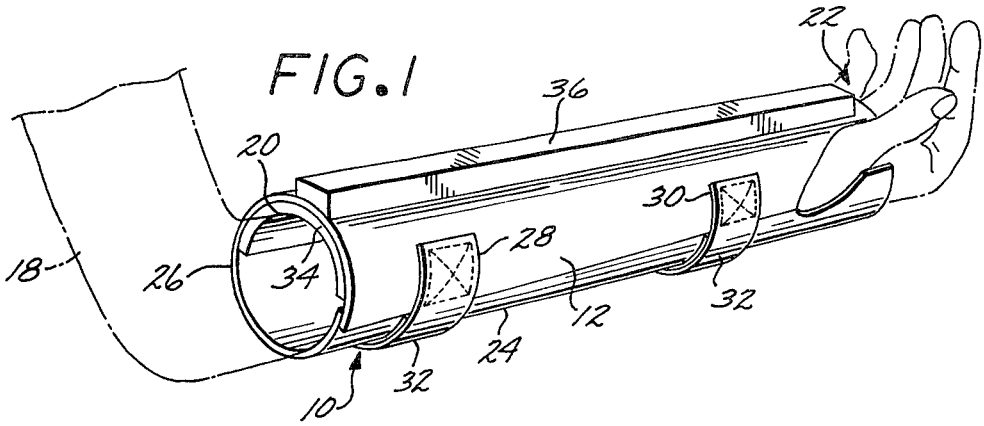
FIG. 1 illustrates the protective device on a wearer's arm.

Referring now to FIG. 1 the protective device 10 is illustrated as an assembly of a rigid, load-bearing splint member 12 that is secured to the arm 18 of a wearer, totally covering the under or inside surface 20 of the forearm and extending to the metacarpal-phthlangic joint generally indicated at 22.

The device is secured to the wearer's arm by a sleeve 24 formed by a fabric band 26 and the like that is longitudinally coextensive with the spline member 12. The fabric band 26 can have one or more closure means such as the tabs 28 and 30 that are secured thereto by stitching 32 and that bear fastening means, e.g., snaps, hooks, eyelets, Velcro fasteners and the like, whereby the tabs 28 and 30 can be fixedly secured to the other surface of splint member 12.

The device can, optionally, contain along its inside surface a cushion layer 34 which can be of any suitable resilient material such as foam rubber, polyurethane foam, and the like. Additionally, splint member 12 can also bear a longitudinal strip 36 of an impact-absorbent material such as polyurethane foam, foam rubber and the like. This layer 36 of impact-absorbent material can be coextensive with the length of splint member 12.

Figure 4:
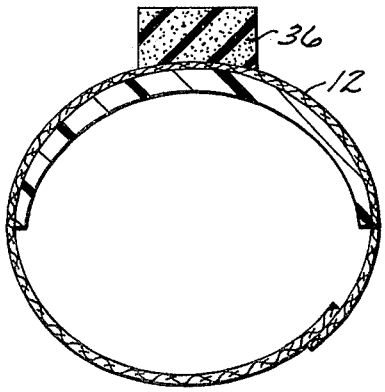

A preferred embodiment of the invention is shown in FIG. 4. In this embodiment two rigid, splint members 12 and 14 are flexibly connected by hinge means 16 permitting a limited degree of flexing of the members. The location of the joint means 16 is at the wrist joint. First, rigid splint member 12 overlies the undersurface of the forearm extending from a point adjacent the elbow and second, rigid splint member 14 overlies the palm, extending to the metacarpal-phthlangic joint.

The device is intended to be worn by children and it is, therefore, desirable to provide an attractive appearance to the device to stimulate its use. Accordingly, the device can be provided with decorative means such as indicia 27 in the form of numerals and the like on fabric patches 29 or decals, etc., that can be permanently or removably attached to the device. The device can also be brightly colored thereby also serving to attract attention of drivers of motor vehicles and the like to the wearer. The attractiveness of the device can also be enhanced by simulating the appearance of a gauntlet, romanticizing its use to the wearer.

The rigid, load-bearing splint members 12 and 14 can be formed of various material such as metal, e.g., steel, aluminum, plastics such as fiber glass reinforced epoxy or polyester resins, polycarbonate, acetal, acrylonitrile-butadiene-styrene copolymers, etc. The fabric sleeve 26 can be formed of any suitable fabric, preferably of a fabric having a sufficient porosity to provide a comfortable fit to the wearer, e.g., fabrics of cotton, rayon, polyester, acrylic resins and the like. The inner cushion layer 34 is provided for comfort of the wearer to permit sufficient flexing for conformity of the inside surface of the rigid member to the wearer's arm and wrist. Typically this cushion layer has a thickness from ⅜ to about 1 inch, preferably about ½ inch. The layer is formed of a soft or flexible foam such as a foam of natural rubber or synthetic elastomers, e.g., butadiene-styrene copolymers and the like. Since this foam cushion layer 34 is flexible, it can extend continuously along the lengths of the splint members 12 and 14.

The strip of cushion 36 can be any impact-absorbent materials such as one-piece or laminate layers of semi-rigid polyurethane foams, foam rubber, laminated foam, and the like. If the band 36 is formed of rigid or semi-rigid foam materials, it is preferred that the band be discontinuous at the joint between splint members 12 and 14 to provide a limited degree of flexing of the assembly at the wrist joint.

Figure 3:
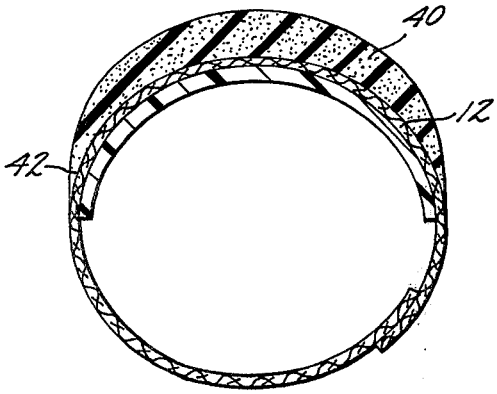
FIGS. 3 and 4 are sectional views showing various construction alternatives of the device.

Various forms of the invention are illustrated in FIGS. 3 and 4. FIG. 4 illustrates the device with the narrow strip 36 of impact absorbent material extending longitudinally along the center of the outer surface of the splint members 12 and 14. Alternatively, the entire outer surface of the rigid, load-bearing splint member 12, and/or 14, can be covered by a layer 40 of the impact-absorbent material. This material can be molded to conform to the exterior, arcuate surface of the splint members and can have feathered edges 42 to provide a smooth exterior surface.

Figure 2:
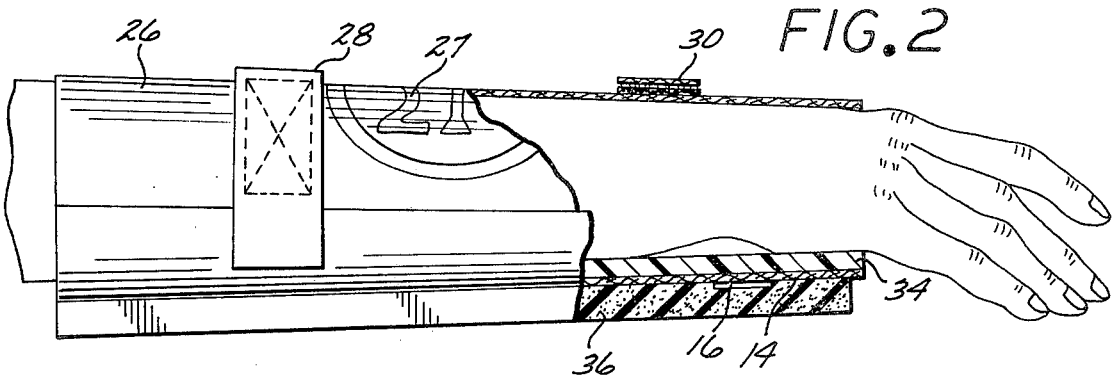
FIG. 2 is a sectional view of a preferred protective device on a wearer's arm.
Figure 5:
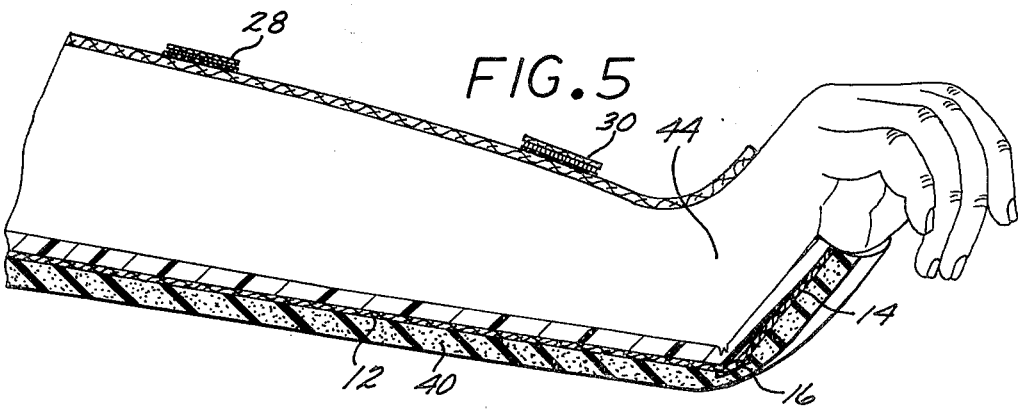
FIG. 5 illustrates the limited flexing capability of the preferred device.

FIG. 5 illustrates the limited degree of flexing possible with the protective device. As there illustrated, the wrist joint 44 is flexed, raising the hand in a manner similar to that immediately prior to impacting against a hard surface when breaking one's fall. The flexible band 16 of hinge material permits the illustrated flexing while the splint members 12 and 14 are, nevertheless, effective in absorbing the impact of the fall and transmitting the impact uniformly across the extremity of the forearm and/or palm of the wearer, thereby avoiding any localized concentration of the impact that could cause a fracture of one or more bones. The embodiment in FIG. 5 illustrates the flexing with a covering 40 of semi-rigid, impact-absorbent foam such as semirigid polyurethane foam. This foam will flex adequately to permit the indicated movement without the necessity for providing a break line at the joint between the splint members such as indicated in FIGS. 1 and 2 for the strip of rigid, impact-absorbent material 36.

The invention has been described with reference to the illustrated and presently preferred embodiment thereof. It is not intended that the invention be unduly limited by this disclosure and description of preferred embodiments. Instead, it is intended that the invention be defined by the means and their obvious equivalents, set forth in the following claims.

I claim:

1. A protective device comprising:

a rigid, load-bearing splint to extend along the underside of the forearm of the wearer thereof from the upper portion of the forearm to the metacarpal-phthlangic joint, overlying the palm of the hand, to provide protective, load-bearing support for the distal, ulna, radius and carpus of said wearer;

cushion means carried on the outside surface of said splint means for absorption of impacts thereto; and limb encircling means including fastening means for repeated attachment and detachment for removably securing said splint to a wearer's forearm and hand.

2. The protective device of claim 1 wherein said splint is formed of a first splint member to extend to the carpus of a wearer, a second splint member to extend from the carpus to said metacarpal-phthlangic joint and flexible hinge means connecting said first and second splint members end-to-end and permitting a limited freedom of flexing therebetween.

3. The protective device of claim 2 including second cushion means carried on the inside surface of at least one of said first and second splint members for adapting to the contour of the wearer's limbs.

4. The protective device of claim 3 wherein said second cushion means are carried on both of said splint members.

5. The protective device of claim 2 wherein said limb encircling means comprises fabric sleeve means.

6. The protective device of claim 5 wherein said fabric sleeve means is formed by a fabric band extending longitudinally, coextensively with said first splint member.

7. The protective device of claim 6 including closure means carried by said sleeve means for fixedly securing said device to the forearm of the wearer.

8. The protective device of claim 2 wherein said splint members are formed of rigid, impact-absorbent plastics.

* * * * *